US008704452B2

(12) United States Patent
Wu

(10) Patent No.: US 8,704,452 B2
(45) Date of Patent: Apr. 22, 2014

(54) ILLUMINATION DEVICE WITH ADJUSTABLE LUMINANCE AND LUMINANCE ADJUSTMENT METHOD THEREOF

(71) Applicant: Lextar Electronics Corporation, Hsinchu (TW)

(72) Inventor: En-Min Wu, Taipei (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 13/682,376

(22) Filed: Nov. 20, 2012

(65) Prior Publication Data

US 2013/0278160 A1 Oct. 24, 2013

(30) Foreign Application Priority Data

Apr. 20, 2012 (TW) ..... 101114241 A

(51) Int. Cl.
*H05B 37/02* (2006.01)

(52) U.S. Cl.
CPC ..... *H05B 37/02* (2013.01)
USPC ..... 315/200 R; 315/307; 315/219; 315/287

(58) Field of Classification Search
USPC ..... 315/200 R, 209 R, 219, 287, 225, 291, 315/307
See application file for complete search history.

(56) References Cited

U.S. PATENT DOCUMENTS

| | | | | |
|---|---|---|---|---|
| 7,235,933 | B1 | 6/2007 | So | |
| 8,258,706 | B2 | 9/2012 | Maruyama et al. | |
| 8,415,890 | B2 * | 4/2013 | Kang et al. | 315/219 |
| 8,461,766 | B2 * | 6/2013 | Nerone | 315/219 |
| 2010/0141162 | A1 | 6/2010 | Matsumoto et al. | |
| 2011/0062877 | A1 * | 3/2011 | Yang et al. | 315/219 |
| 2011/0133665 | A1 | 6/2011 | Huang | |
| 2012/0051757 | A1 | 3/2012 | Nishino et al. | |
| 2013/0244217 | A1 * | 9/2013 | Potts et al. | 434/324 |

FOREIGN PATENT DOCUMENTS

| | | | |
|---|---|---|---|
| JP | 2006-286275 | A | 10/2006 |
| JP | 2010-92776 | A | 4/2010 |
| JP | 2010-118270 | A | 6/2010 |
| JP | 2010-135136 | A | 6/2010 |
| JP | 2011176191 | | 9/2011 |
| JP | 2012003991 | | 1/2012 |
| JP | 2012-28184 | A | 2/2012 |
| JP | 2012-69505 | A | 4/2012 |

* cited by examiner

*Primary Examiner* — Don Le

(74) *Attorney, Agent, or Firm* — Muncy, Geissler, Olds & Lowe, P.C.

(57) ABSTRACT

The present application relates to an illumination device having a light source module, a power supply module, a driving module, a control module and a start module. The driving module outputs a driving current to the light source module based on a power supply from the power supply module. The control module controls the magnitude of the driving current based on a first voltage signal generated by the power source module. After receiving the first voltage signal, the control module controls the driving module to steadily increase the driving current in a first stage output. After receiving the first voltage signal again, the control module controls the driving module to output a constant driving current equal to the driving current at the end of the first stage.

17 Claims, 6 Drawing Sheets

ILLUMINATION DEVICE WITH ADJUSTABLE LUMINANCE AND LUMINANCE ADJUSTMENT METHOD THEREOF

BACKGROUND OF THE INVENTION

1. Field of the Invention

The invention relates to an illumination device; in particular, to an illumination device with adjustable luminance and a luminance adjustment method thereof.

2. Description of the Prior Art

Except a lamp with fixed luminance providing single luminance, the current illumination device can include luminance adjusting mechanisms, such as a tri-electrode AC switch (TRIAC), a pulse width modulation (PWM) circuit, or a multi-stage switch, to adjust the luminance of the lights outputted by the illumination device according to illumination requirements.

FIG. 1A illustrates a schematic diagram of the circuit of a conventional illumination device 10; FIG. 1B illustrates a schematic diagram of the relationship between the light luminance of a light source module 40 and the outputted current of a tri-electrode AC switch 30 shown in FIG. 1A. As shown in FIG. 1A, the conventional illumination device 10 includes an external power supply 20, the tri-electrode AC switch 30, and the light source module 40. And, the user can adjust the tri-electrode AC switch 30 to adjust the current outputted to the light source module 40 and the luminance of the lights generated by the light source module 40. As shown in FIG. 1B, there are positive correlation and linear relationship between the luminance of the lights generated by the light source module 40 and the outputted current of the tri-electrode AC switch 30.

The conventional illumination device 10 can achieve linear control of the luminance through the tri-electrode AC switch 30. However, because the outputted current of the tri-electrode AC switch 30 is not stable enough, the LED with higher current sensitivity may have luminance flicker problems due to the unstable outputted current amplitude of the tri-electrode AC switch 30. In addition, there is also the problem of poor energy converting efficiency during the process of the tri-electrode AC switch 30 converting the external power into the current. Therefore, the tri-electrode AC switch 30 is not suitable to be used in the LED light source module 40.

FIG. 2A illustrates a schematic diagram of the circuit of another conventional illumination device 12; FIG. 2B illustrates a schematic diagram of the relationship between the light luminance of the light source module 40 and the switching points of a switch 60 shown in FIG. 2A. As shown in FIG. 2A, the conventional illumination device 12 includes the light source module 40, a control module 50, and the switch 60. The switch 60 conducts the voltage of the external power supply 20 to the control module 50 only when it is switched from the open circuit state (OFF) to the conduction state (ON). After every time the control module 50 receives the external power voltage, the control module 50 will increase the current outputted to the light source module 40 according to a setup value. In this way, the user has to switch the switch 60 several times between the open circuit state and the conduction state to adjust the outputted voltage of the control module 50 and the light luminance generated by the light source module 40.

When the user uses the above-mentioned conventional illumination device 12, it is inconvenient for the user that he/she has to switch on and off the switch 60 according to different light luminance. In addition, the control module 50 shown in FIG. 2A can only increase the amplitude of the outputted current in a step type. Therefore, the user cannot control the conventional illumination device 12 to obtain the light luminance between two steps. In other words, the conventional illumination device 12 shown in FIG. 2A cannot achieve the linear control of illumination.

Therefore, how to achieve linear illumination output and avoid luminance flicker at the same time and how to increase electrical energy converting efficiency will be important issue for illumination adjustment of the current illumination device.

SUMMARY OF THE INVENTION

A scope of the invention is to provide an illumination device with adjustable luminance and a luminance adjustment method thereof for the user to perform linear illumination adjustment through a single switch without any steps.

The illumination device of the invention includes a light source module, a power supply module, a driving module, a control module, and a start module. The driving module is coupled to the light source module and the power supply module, wherein the driving module receives a direct current voltage and converts the direct current voltage into a driving voltage and outputs a driving current to the light source module. The control module is coupled to the driving module. The control module controls a magnitude of the driving current outputted by the driving module based on a first voltage signal outputted by the power source module.

The start module is coupled to the power supply module, wherein the start module selectively enters into a conduction state to allow the power supply module to provide a power to the driving module and output the first voltage signal to the control module. The start module selectively enters into an open circuit state to cut off the power received by the driving module from the power supply module. It is preferred that the start module uses a manual switching mode to selectively enter into a conduction state or an open circuit. After the control module receives the first voltage signal, the control module will control the driving module to perform a first stage output to steadily increase an amplitude of the driving current. After the start module selectively enters into the open circuit state, the start module will selectively enters into the conduction state again, and the control module will receive the first voltage signal again and control the driving module to perform a second stage output to output a constant driving current equal to the driving current at the end of the first stage output.

In another embodiment of the invention, the illumination device further includes a coupling module disposed between the start module and the control module. After the start module enters into the conduction state, the coupling module will output the first voltage signal to the control module. In addition, the illumination device is preferred to further include a micro-controller used for outputting a pulse width modulation signal to the driving module for the driving module to generate the driving current having corresponding amplitude according to a pulse width of the pulse width modulation signal. The micro-controller is preferred to steadily increase the pulse width of the pulse width modulation signal in the first stage output. Furthermore, the power supply module further includes an energy storage component coupled to the driving module. When the first stage output is finished, the energy storage component will provide the power that the micro-controller of the control module needs.

In another embodiment of the invention, the illumination device further includes an output switching module coupled to the control module. The output switching module selectively outputs a mode converting signal to the control module to control the driving module to perform a default output and output the driving current according to a default value.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

Figure 1A:
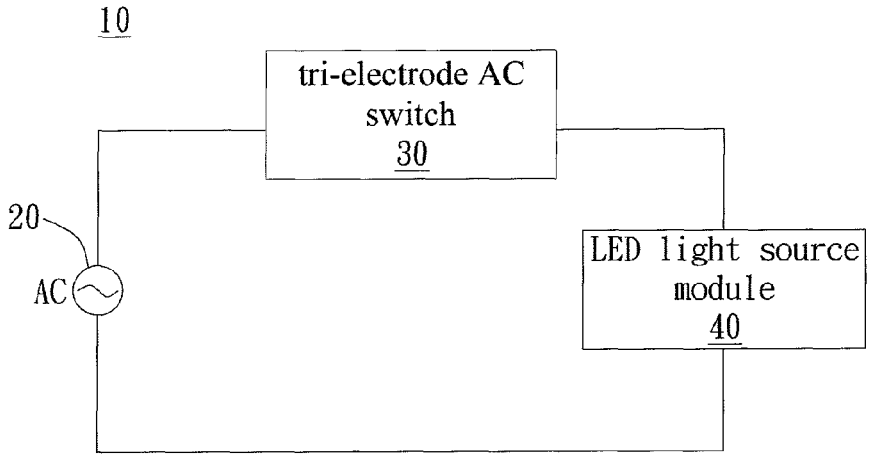
FIG. 1A (PRIOR ART)
FIG. 1A illustrates a schematic diagram of the circuit of a conventional illumination device 10.
Figure 1B:
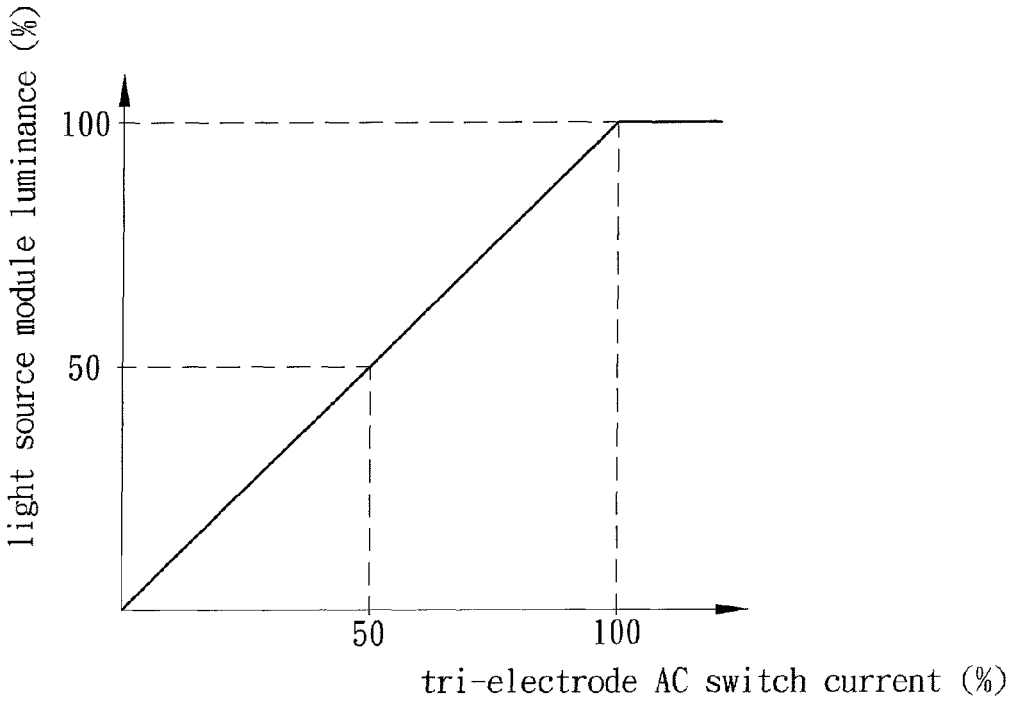
FIG. 1B (PRIOR ART)
FIG. 1B illustrates a schematic diagram of the relationship between the light luminance of a light source module 40 and the outputted current of a tri-electrode AC switch 30 shown in FIG. 1A.
Figure 2A:
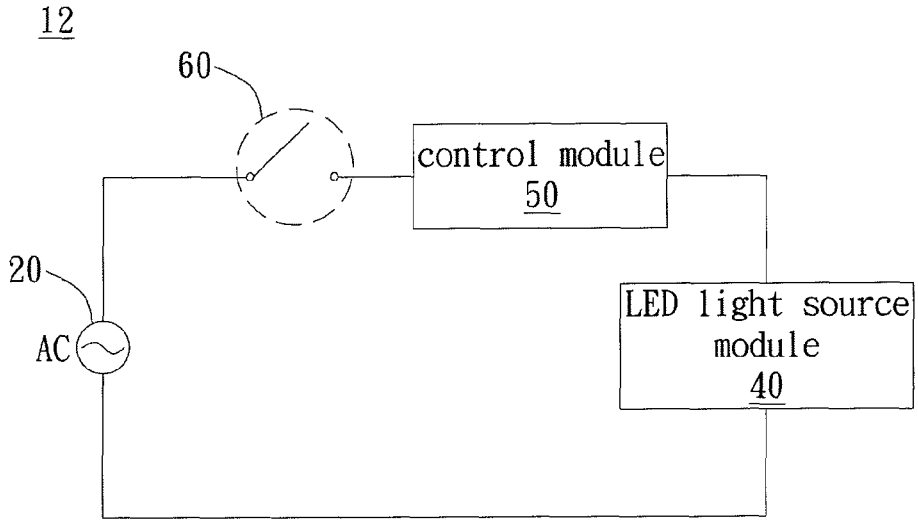
FIG. 2A (PRIOR ART)
FIG. 2A illustrates a schematic diagram of the circuit of another conventional illumination device 12.
Figure 2B:
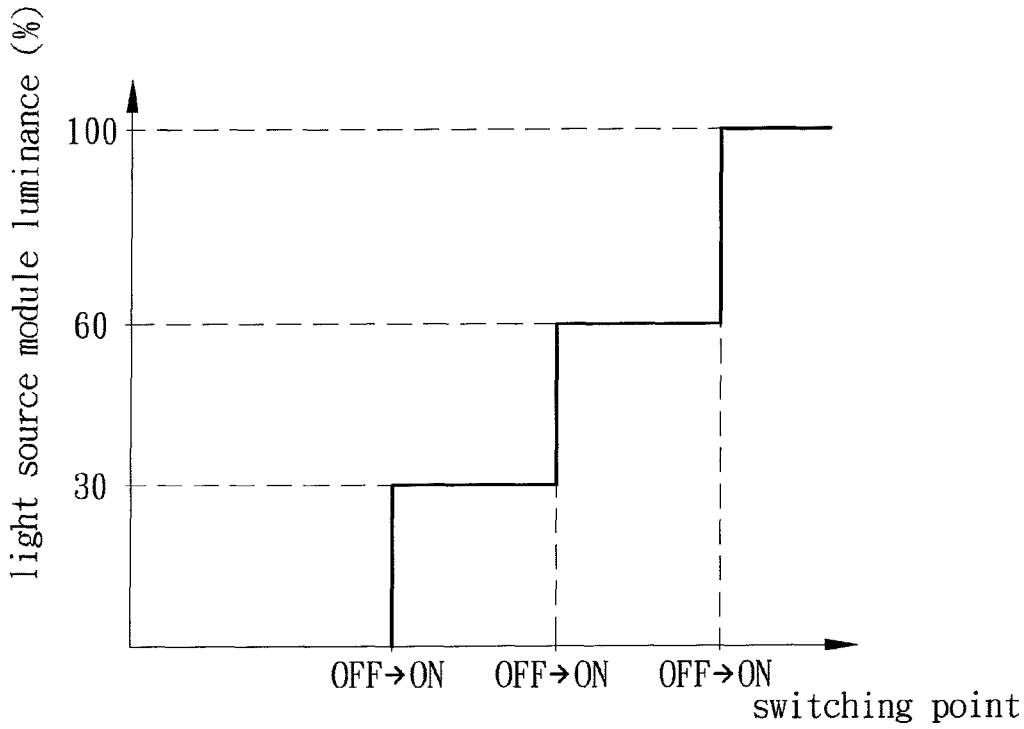
FIG. 2B (PRIOR ART)
FIG. 2B illustrates a schematic diagram of the relationship between the light luminance of the light source module 40 and the switching points of a switch 60 shown in FIG. 2A.
Figure 3:
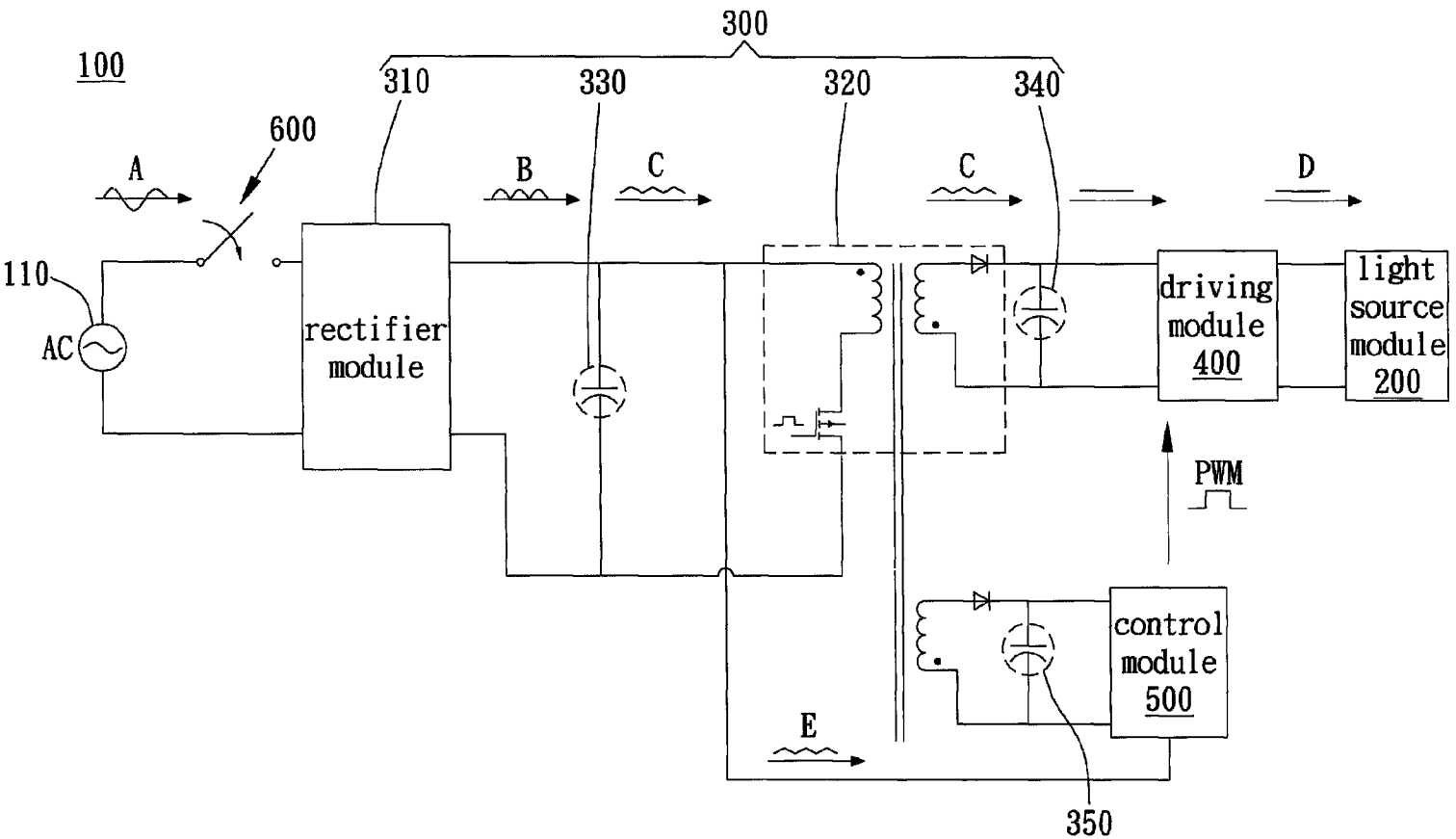
FIG. 3 illustrates a schematic diagram of an embodiment of an illumination device 100 of the invention.

Please refer to FIG. 3. FIG. 3 illustrates a schematic diagram of an embodiment of an illumination device 100 of the invention. As shown in FIG. 3, the illumination device 100 includes a light source module 200, a power supply module 300, a driving module 400, a control module 500, and a start module 600. In this embodiment, the start module 600 can be switched to enter into the conduction state to allow the power supply module 300 to output power to the driving module 400. The driving module 400 receives a DC voltage from the power supply module 300 and converts it into a driving voltage and outputs a driving current to the light source module 200 to generate lights. On the other hand, the start module 600 can be switched to enter into the open circuit state to cut off the electrical connection between the power supply module 300 and the driving module 400. In other words, the start module 600 can stop the power supply module 300 outputting power to the driving module 400 by entering into the open circuit state.

In addition, the light source module 200 of this embodiment is a light emitting diode (LED) light source module 200 including a plurality of LEDs, but not limited to this. In the other embodiment, the light source module 200 of the invention can be any other conventional light source generating devices capable of being driven by AC voltage or DC voltage to generate lights. In addition, the driving module 400 of this embodiment is a DC-DC converter, and the control module 500 is a micro-controller.

In this embodiment, the power supply module 300 further includes a rectifier module 310, a voltage increasing/decreasing module 320, a primary filter component 330, a secondary filter component 340, and an energy storage component 350. In this embodiment, the primary filter component 330, the secondary filter component 340, and the energy storage component 350 can be capacitive components. The start module 600 includes electrical components such as a button or a touch sensing device for the user to switch it between the open circuit state and the conduction state in a manual control way. As shown in FIG. 3, the start module 600 is electrically connected with the rectifier module 310 and the external power supply 110. After the user switches the start module 600 to the conduction state in the manual control way, the start module 600 will input the high-voltage AC waves (110V or 220V) provided by the external power supply 110 into the rectifier module 310, and the rectifier module 310 will convert the high-voltage AC waves into a plurality of positive full waves. In other words, the rectifier module 310 in this embodiment is a full wave rectifier or other electrical component including bridge circuit used to convert the AC voltage having two-way change into the DC voltage having single-way change.

The primary filter component 330 receives the full-wave voltage B generated by the rectifier module 310 and performs initial filtering operations on the full-wave voltage B to output a first voltage signal C, wherein the first voltage signal C is an AC voltage having ripples. The voltage increasing/decreasing module 320 of this embodiment is a transformer used for receiving the first voltage signal C outputted by the primary filter component 330 and generating AC voltages having the same and lower or higher wave forms. In other words, the voltage increasing/decreasing module 320 is used to lower or increase the amplitude of the first voltage signal C outputted by the primary filter component 330.

After the secondary filter component 340 receives the first voltage signal C generated by the voltage increasing/decreasing module 320, the secondary filter component 340 will further filter the ripples and frequency components of the first voltage signal C to output a DC voltage to the driving module 400. After the driving module 400 receives the DC voltage, the driving module 400 will output a driving current D to the light source module 200 according to the instructions of the control module 500 for the light source module 200 to generate lights having corresponding luminance according to the amplitude of the driving current D.

The control module 500 outputs a pulse width modulation signal PWM to the driving module 400, and the driving module 400 will output the DC voltage having corresponding amplitude according to the width of the pulse width modulation signal PWM. The energy storage component 350 is coupled between the voltage increasing/decreasing module 320 and the control module 500 and has functions of storing electrical energy and filtering. The energy storage component 350 will filter the ripples and frequency components of the first voltage signal C to output a DC voltage to the control module 500. When the start module 600 is switched to the open circuit state, the electrical energy stored in the energy storage component 350 can be temporarily supplied to the control module 500.

In this embodiment, the control module 500 controls the pulse voltage outputted to the driving module 400 according to whether the start module 600 enters into the conduction state or not. In detail, the control module 500 detects the first voltage signal C outputted by the primary filter component 330 to judge whether the start module 600 is under the conduction state or the open circuit state. After the start module 600 enters into the conduction state, the start module 600 will output the first voltage signal C to the control module 500 through the rectifier module 310 and the primary filter component 330. After the control module 500 receives the first voltage signal C, the control module 500 will start to output the pulse voltage to the driving module 400 to control the driving module 400 to start the first stage output. In the first stage output, the control module 500 will steadily increase the width of the pulse width modulation signal PWM. Therefore, the driving module 400 will also correspondingly output the driving current D having steadily increased amplitude to the light source module 200. By doing so, the light source module 200 can gradually increase the light luminance for the user to reference.

As above, when the user switches the start module 600 to the conduction state (set in the ON state), the light luminance will be gradually increased. After the light luminance is increased to the desired light luminance, the user can control the start module 600 to enter into the open circuit state (set in the OFF state) in a manual control way. After the start module 600 enters into the open circuit state, the start module 600 will control the rectifier module 310 and the primary filter component 330 to output the second voltage signal E to the control module 500. After the control module 500 receives the second voltage signal E, the control module 500 will stop increasing the width of the pulse width modulation signal PWM and maintain the pulse width modulation signal PWM having fixed width. At this time, the energy storage component 350 can provide the start module 600 the power needed for the control module 500 after it enters into the open circuit state. Since the start module 600 enters into the open circuit state, the power supply module 300 and the driving module 400 will output no signal. Then, after the user switches the start module 600 to the conduction state (set in the ON state) again, the power supply module 300 will output the first voltage signal C to the control module 500 again to control the driving module 400 to perform the second stage output. In the second stage output, the driving module 400 will use the pulse width modulation signal PWM having fixed width outputted by the control module 500 as the fixed value of the driving current D to output the driving current D having the fixed value. That is to say, in the second stage output, the driving module 400 steadily outputs a constant driving current equal to the driving current D at the end of the first stage output, and the light source module 200 will generate the light luminance that user wants according to the constant driving current D.

In the embodiment shown in FIG. 3, the control module 500 determines the driving current D outputted by the driving module 400 according to the DC voltage generated by the energy storage component 350, but not limited to this. In other embodiments, the control module 500 can directly measure the driving current D or determine the amplitude of the driving current D according to the pulse voltage width used to control the driving module 400 in the first stage output. In addition, the illumination device 100 in this embodiment uses a button or a touch sensing device as the start module 600 for the user to switch it between the conduction state and the open circuit state, but not limited to this. In other embodiments, the start module 600 can also include a voice-control switch used for identifying the frequency and the volume of the voice generated by the user to be switched between the conduction state and the open circuit state.

Figure 4:
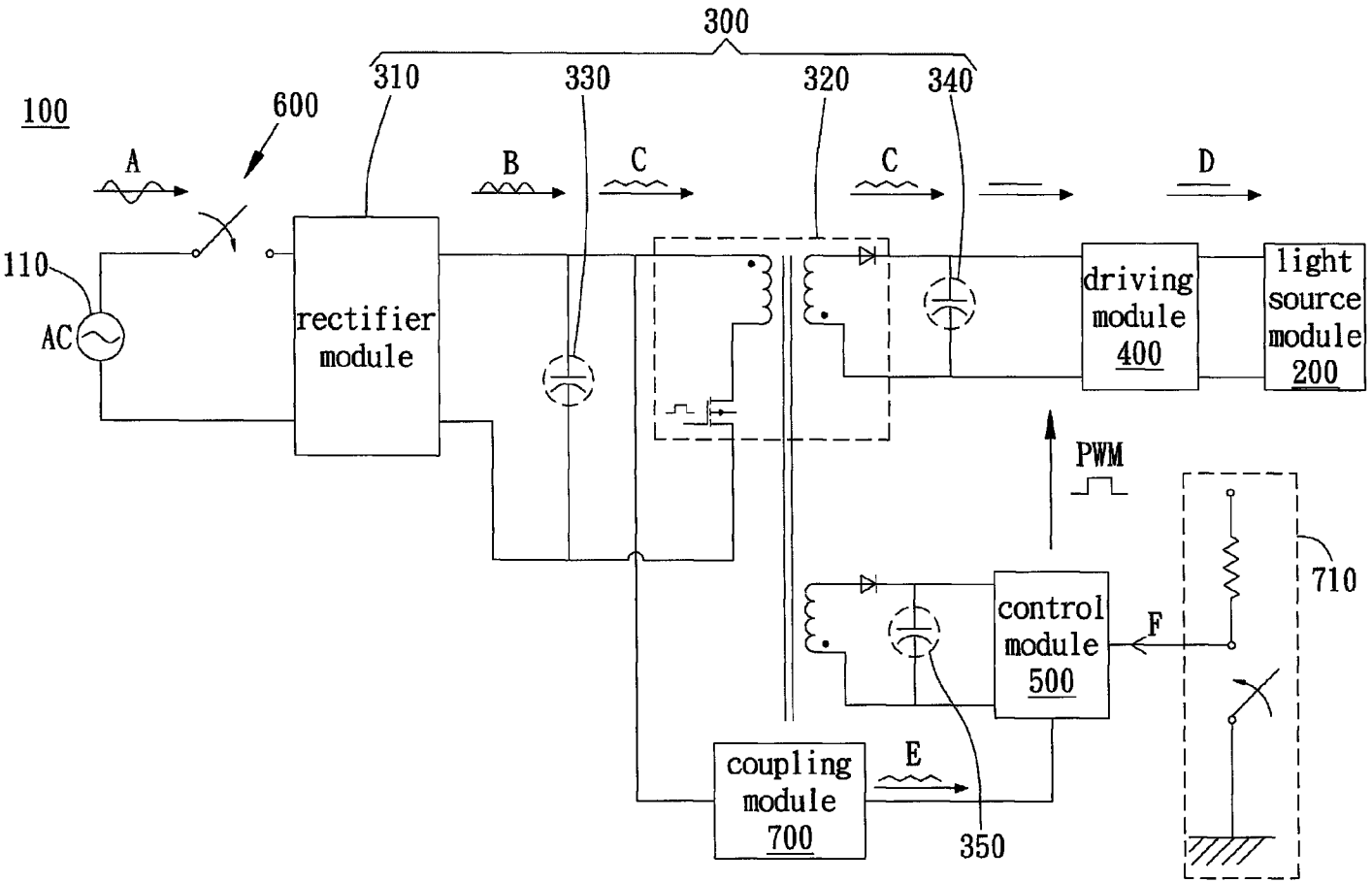
FIG. 4 illustrates another embodiment of the illumination device 100 in this invention.

FIG. 4 illustrates another embodiment of the illumination device 100 in this invention. As shown in FIG. 4, the illumination device 100 further includes a coupling module 700 and an output switching module 710. The coupling module 700 is disposed and coupled between the control module 500 and the control module 500. After the start module 600 enters into the conduction state, the start module 600 will receive the first voltage signal C outputted by the power supply module 300 and output it to the control module 500 in a coupling way. In this embodiment, it can be known that the control module 500 detects the AC voltage signal outputted by the coupling module 700 to determine whether the start module 600 is under the conduction state or the open circuit state. In addition, the coupling module 700 of the embodiment is preferred to be a photoelectric coupling component used to cut off the electrical connection between the voltage increasing/decreasing module 320 and the control module 500 to assume that the power supply module 300 is an isolated circuit.

On the other hand, as shown in FIG. 4, the output switching module 710 is coupled to the control module 500 used to output a mode converting signal F to the control module 500 according to the operation of the user. After the control module 500 receives the mode converting signal F, the control module 500 will perform specific output according to the default value pre-stored in the control module 500 itself. In this embodiment, the specific output means steadily outputting the pulse width modulation signal PWM having fixed width to the driving module 400 to instruct the driving module 400 to output the driving current D having fixed amplitude to the light source module 200 to generate lights having fixed luminance. As above, when the user already has a desired fixed luminance, the user can directly use the output switching module 710 to control the driving module 400 to input the fixed driving current D to the light source module 200 according to the specific output. In this way, the light source module 200 can directly output the light luminance matching the requirement of the user according to the driving current D in the shortest time.

The value of the specific output can be set by the user according to his/her own requirements to match different specific functions. For example, the default value stored by the control module 500 can correspond to 70% of duty cycle to be a reading mode, or correspond to 20% of duty cycle to be a film/brief mode to match some applications set in advance. After the control module 500 receives the mode converting signal F, the control module 500 will perform the specific output; that is to say, the control module 500 will steadily output the pulse width modulation signal PWM having 70% or 20% duty cycle widths to the driving module 400. On the other hand, after the driving module 400 receives the pulse width modulation signal PWM, the driving module 400 will steadily output the driving current D having amplitude corresponding to 70% or 20% duty cycle to the light source module 200 to output the fixed luminance.

In addition, the illumination device 100 of the embodiment can selectively switch the specific output corresponding to the fixed amplitude or the step output corresponding to the steadily increased amplitude. Specifically, during the process of the driving module 400 performing the first stage output (steadily increased the amplitude of the driving current D) or the second stage output (outputting the driving current D having fixed amplitude), the user can control the output switching module 710 to instruct the control module 500 to transmit the pulse width modulation signal PWM of the specific output to the driving module 400. In other words, the user of the illumination device 100 can selectively control the driving module 400 to steadily output the driving current D having amplitude corresponding to the specific output to the light source module 200 and output the corresponding fixed luminance.

On the other hand, when the control module 500 performs specific output, the user can also use the start module 600 again to instruct the control module 500 and the driving module 400 to perform the first stage output again to steadily increase the amplitude of the driving current D. This embodiment can be achieved by setting the control module 500.

Figure 5:
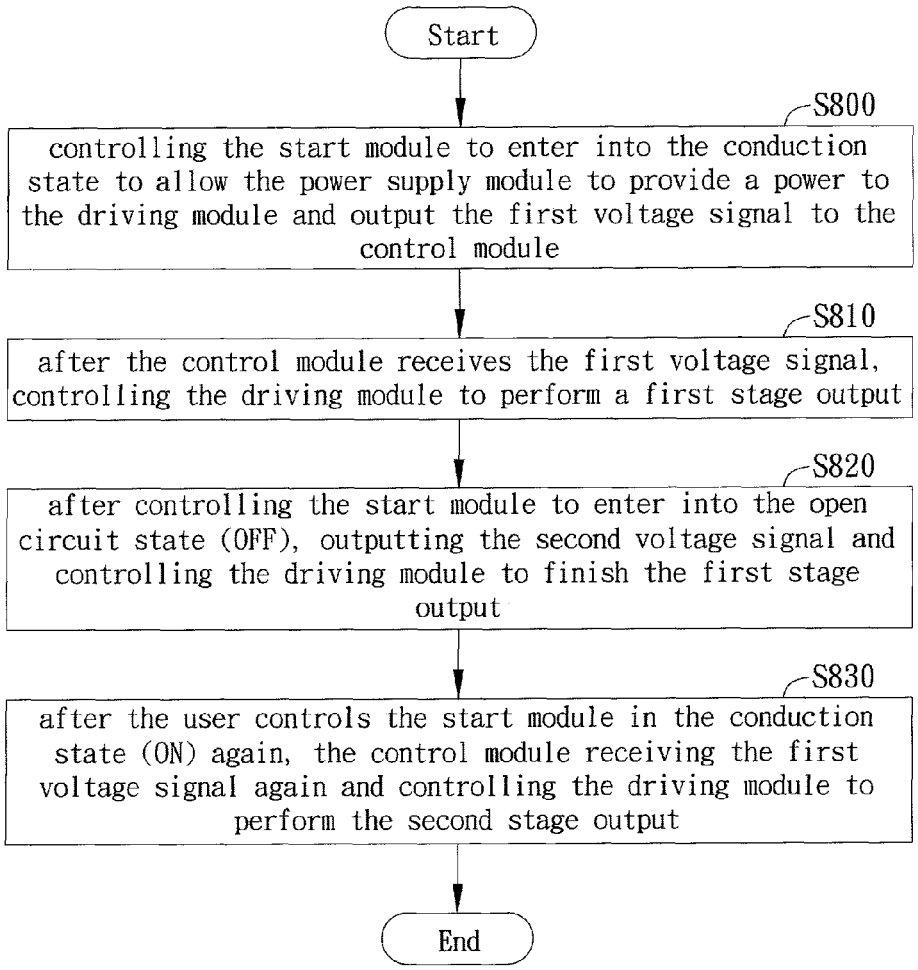
FIG. 5 shows the flowchart of the luminance adjustment method of the illumination device.

FIG. 5 shows the flowchart of the luminance adjustment method of the illumination device. As shown in FIG. 5, the method includes step S800 of controlling the start module to enter into the conduction state to allow the power supply module to provide a power to the driving module and output the first voltage signal to the control module. The start module is disposed between the external power supply and the power supply module. After the start module enters into the conduction state, the power supply module will receive high-voltage AC waves from the power supply and then output the first voltage signal to the control module according to the high-voltage AC waves. In other words, after the start module enters into the conduction state, the start module will control the power supply module to output the first voltage signal to the control module.

In addition, the start module can be a button or a touch sensing device for the user to switch it between the conduction state and the open circuit state, but not limited to this. In other embodiments, the start module can also include a voice-control switch used for identifying the frequency and the volume of the voice generated by the user to be switched between the conduction state and the open circuit state.

In addition, the method can further include step S810, after the control module receives the first voltage signal, controlling the driving module to perform a first stage output. The driving module receives the DC voltage from the power supply module and outputs the driving current to the light source module according to the amplitude corresponding to the first stage output under the instruction of the control module at the same time for the light source module to output lights having corresponding luminance according to the driving current. In this embodiment, the control module will instruct the driving module to gradually increase the amplitude of the outputted driving current from 0V. Furthermore, in the first stage output, the driving current has an output voltage having a gradient, but not limited to this. In other embodiments, the driving module can output the output voltage having radian or a step type in the first stage output.

The method can further includes step S820, after controlling the start module to enter into the open circuit state (OFF), outputting the second voltage signal and controlling the driving module to finish the first stage output. In the first stage output, the driving module will gradually increase the amplitude of the driving current to increase the luminance of the lights outputted by the light source module. When the light luminance meets the requirement of the user, the user can manually switch the start module to the open circuit state. After the start module enters into the open circuit state, the start module will control the power supply module to transmit the second voltage signal to the control module. In this embodiment, after the start module enters into the open circuit state, the power supply module will stop receiving the high-voltage AC waves and output the second voltage signal of 0V to the control module, but not limited to this. In other embodiments, after the start module enters into the open circuit state, the power supply module can steadily receive the high-voltage AC waves from the power supply and output the second voltage signal higher than 0V to the control module due to the structure adjustment. In addition, after the control module receives the second voltage signal, the control module will stop increasing the driving current in the first stage output.

The method can further include step S830, after the user controls the start module in the conduction state (ON) again, the control module receiving the first voltage signal again and controlling the driving module to perform the second stage output. In detail, in the second stage output, the driving module will use the pulse width modulation signal PWM having fixed width outputted by the control module as the fixed value of the driving current and steadily output it. That is to say, the driving module steadily outputs a constant driving current in the second stage output equal to the driving current at the end of the first stage output, and the light source module will generate the light luminance that user wants according to the constant driving current. In other words, in order to control the driving module to perform the second stage output, the user has to control the start module to enter into the conduction state again. By doing so, the power supply module will output the first voltage signal to the control module and the driving module again. After the control module receives the first voltage signal again, the control module will detect the amplitude of the driving current outputted by the driving module at that time and control the driving module to steadily output the driving current having the fixed value of the amplitude. In other words, the driving module will output the driving current having fixed amplitude to the light source module in the second stage output, and the light source module will output the lights having fixed luminance.

Figure 6:
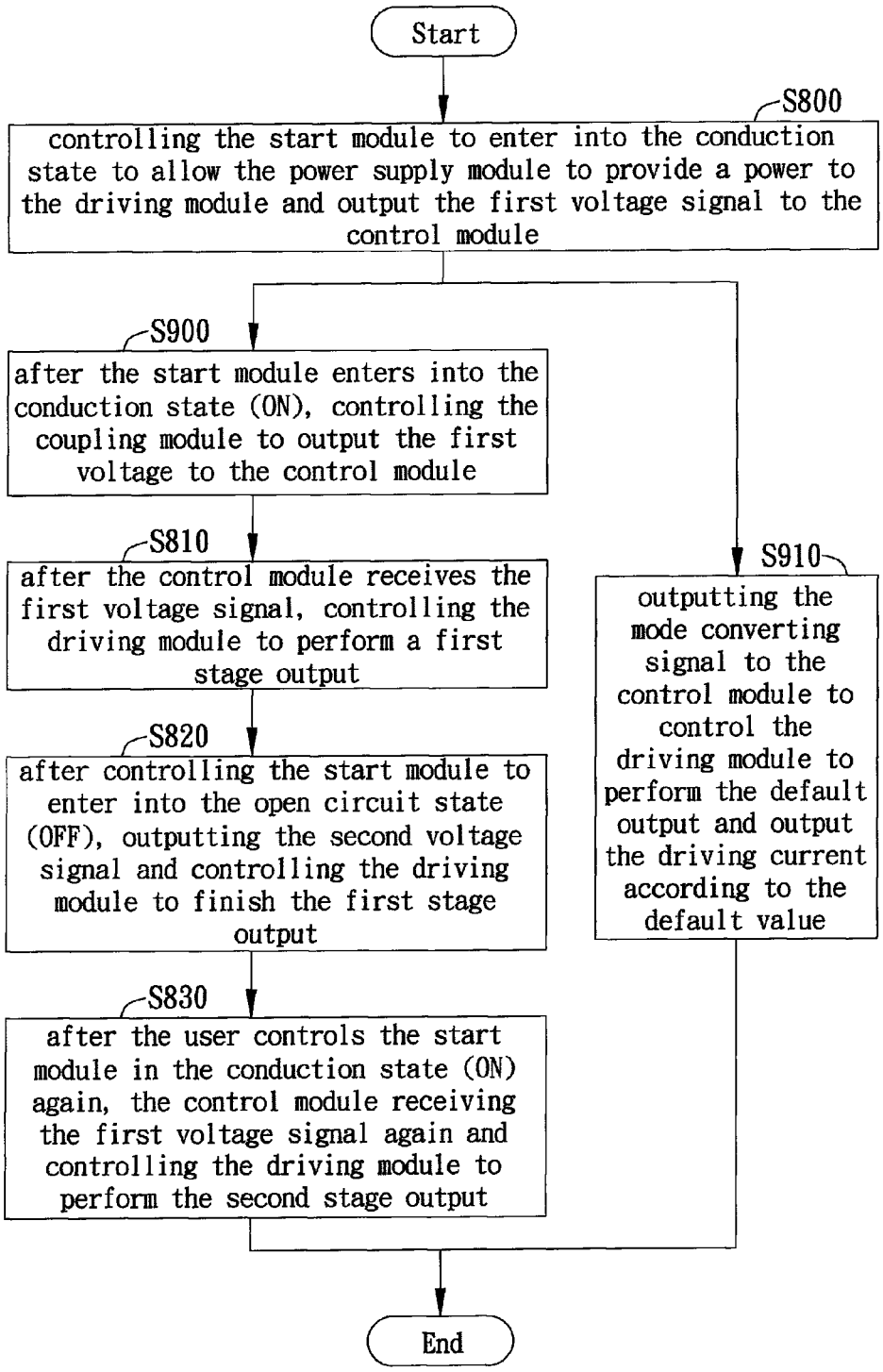
FIG. 6 shows another embodiment of the luminance adjustment method of the illumination device.

FIG. 6 shows another embodiment of the luminance adjustment method of the illumination device. The method can further include step S900, after the start module enters into the conduction state (ON), controlling the coupling module to output the first voltage to the control module. In the embodiment of FIG. 6, the illumination device can further include a coupling module and an output switching module. The coupling module is disposed between the start module and the control module. After the start module enters into the conduction state, the coupling module will receive the first voltage signal and decrease the amplitude of the first voltage signal and output it to the control module. In other words, the first voltage signal received by the control module and the first voltage signal outputted by the voltage decreasing module have the same wave form and different amplitudes. In addition, the coupling module is preferred to be a photoelectric coupling component to cut off any connections between the voltage decreasing module and the control module. By doing so, the coupling module can avoid that the control module is damaged due to the too larger amplitude of the first voltage signal outputted by the voltage decreasing module.

In addition, the method further includes step S910, outputting the mode converting signal to the control module to control the driving module to perform the default output and output the driving current according to the default value. In the embodiment of FIG. 6, the illumination device further includes an output switching module used for outputting a mode converting signal to the control module according to the operation of the user. After the control module receives the mode converting signal, the control module will output a pulse voltage having fixed width to the driving module according to a default value stored in the control module itself to instruct the driving module to output the driving current having fixed amplitude to the light source module to generate lights having fixed luminance. By doing so, the user can adjust light luminance based on his/her requirements or selectively use the output switching module to fix the light luminance.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An illumination device, comprising:

a light source module;

a power supply module;

a driving module, coupled to the light source module and the power supply module, wherein the driving module receives a direct current voltage and converts the direct current voltage into a driving voltage and outputs a driving current to the light source module;

a control module, coupled to the driving module, the control module controlling a magnitude of the driving current outputted by the driving module based on a first voltage signal outputted by the power source module; and a start module, coupled to the power supply module, wherein the start module selectively enters into a conduction state to allow the power supply module to provide a power to the driving module and output the first voltage signal to the control module, the start module selectively enters into an open circuit state to cut off the power received by the driving module from the power supply module;

wherein after the control module receives the first voltage signal, the control module will control the driving module to perform a first stage output to steadily increase an amplitude of the driving current, and after the start module selectively enters into the open circuit state, the start module will selectively enters into the conduction state again, the control module will receive the first voltage signal again and control the driving module to perform a second stage output to output a constant driving current equal to the driving current at the end of the first stage output.

2. The illumination device of claim 1, wherein the start module is switched to enter into the conduction state or the open circuit state by voice or manual control.

3. The illumination device of claim 1, further comprising a coupling module disposed between the start module and the control module, after the start module enters into the conduction state, the coupling module will output the first voltage signal to the control module.

4. The illumination device of claim 3, wherein the coupling module comprises a photoelectric coupling component.

5. The illumination device of claim 4, wherein after the start module enters into the open circuit state, the start module will control the coupling module to output a second voltage signal to the control module to control the driving module to finish the first stage output.

6. The illumination device of claim 5, wherein the control module further comprises:

a micro-controller, for outputting a pulse width modulation signal to the driving module for the driving module to generate the driving current having corresponding amplitude according to a pulse width of the pulse width modulation signal;

wherein the micro-controller steadily increases the pulse width of the pulse width modulation signal in the first stage output, and outputs the pulse width modulation signal having the fixed pulse width in the second stage output.

7. The illumination device of claim 6, further comprising:

an output switching module, coupled to the control module, the output switching module selectively outputting a mode converting signal to the control module to control the driving module to perform a default output and output the driving current according to a default value.

8. The illumination device of claim 6, wherein the power supply module comprises:

an energy storage component, coupled to the driving module, when the first stage output is finished, the energy storage component providing the power that the micro-controller of the control module needs.

9. The illumination device of claim 1, wherein after the start module enters into the open circuit state, the start module controls a rectifier module and a primary filter component in the power supply module to output a second voltage signal to the control module to control the driving module to finish the first stage output.

10. A luminance adjustment method of an illumination device, the illumination device comprising a light source module, a power supply module, a driving module, a control module, and a start module, wherein the luminance adjustment method comprises the steps of:

controlling the start module to selectively enter into a conduction state or an open circuit state to control the electrical connection between the power supply module and the driving module, wherein after the start module enters into the conduction state, the start module will output a first voltage signal to the control module;

after the control module receives the first voltage signal, controlling the control module to control the driving module to perform a first stage output to steadily increase an amplitude of the driving current outputted to the light source module; and when the control module receives the first voltage signal again, controlling the control module to control the driving module to perform a second stage output to output a constant driving current equal to the driving current at the end of the first stage output.

11. The luminance adjustment method of claim 10, further comprising:

controlling the start module to enter into the conduction state to allow the power supply module to provide a power to the driving module and output the first voltage signal to the control module; and controlling the start module to enter into the open circuit state to cut off the power received by the driving module from the power supply module.

12. The luminance adjustment method of claim 11, further comprising using voice or manual control to switch the start module to enter into the conduction state or the open circuit state.

13. The luminance adjustment method of claim 12, further comprising after the start module enters into the conduction state, controlling a coupling module to output the first voltage signal to the control module.

14. The luminance adjustment method of claim 13, further comprising using a photoelectric coupling component to detect the state of the starting module and after the photoelectric coupling component detects that the starting module enters into the conduction state, the photoelectric coupling component outputting the first voltage signal to the control module.

15. The luminance adjustment method of claim 10, further comprising:

controlling the start module to output a second voltage signal after the start module enters into the open circuit state; and when detecting the second voltage signal, controlling the driving module to finish the first stage output.

16. The luminance adjustment method of claim 15, further comprising:

steadily increasing a pulse width of a pulse width modulation signal inputted to the driving module in the first stage output; and outputting the pulse width modulation signal having the fixed pulse width to the driving module in the second stage output.

17. The luminance adjustment method of claim 11, further comprising outputting a mode converting signal to the control module to control the driving module to perform a default output and output the driving current according to a default value.

* * * * *